US010988917B2

(12) United States Patent
Higuchi et al.

(10) Patent No.: US 10,988,917 B2
(45) Date of Patent: Apr. 27, 2021

(54) TOILET FLUSH DEVICE AND TOILET DEVICE

(71) Applicant: LIXIL Corporation, Tokyo (JP)

(72) Inventors: Ken Higuchi, Tokyo (JP); Takeya Ichiyanagi, Tokyo (JP); Yasuhiro Kondo, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 16/090,143

(22) PCT Filed: Jan. 24, 2017

(86) PCT No.: PCT/JP2017/002270
§ 371 (c)(1),
(2) Date: Sep. 28, 2018

(87) PCT Pub. No.: WO2017/169006
PCT Pub. Date: Oct. 5, 2017

(65) Prior Publication Data

US 2019/0112798 A1 Apr. 18, 2019

(30) Foreign Application Priority Data

Mar. 31, 2016 (JP) ..... JP2016-070586

(51) Int. Cl.
*E03D 11/08* (2006.01)
*E03F 5/06* (2006.01)
*E03F 5/04* (2006.01)

(52) U.S. Cl.
CPC ..... *E03D 11/08* (2013.01); *E03F 5/04* (2013.01); *E03F 5/041* (2013.01); *E03F 5/06* (2013.01)

(58) Field of Classification Search
CPC ..... E03D 11/08; E03D 11/10
USPC ..... 4/421
See application file for complete search history.

(56) References Cited

U.S. PATENT DOCUMENTS 6,986,172 B2 * 1/2006 Hidetaka ..... E03D 1/28 4/421
2014/0289947 A1 * 10/2014 Hirakawa ..... E03D 11/08 4/421

FOREIGN PATENT DOCUMENTS

| | | | | |
|---|---|---|---|---|
| JP | 58-103275 | | 7/1983 | |
| JP | S58103275 | * | 7/1983 | ..... E03D 11/10 |
| JP | 2003-213773 | | 7/2003 | |
| JP | 2003213773 A | * | 7/2003 | |
| JP | 2008-240401 A | | 10/2008 | |
| JP | 2008-261169 A | | 10/2008 | |
| JP | 2014-114637 | | 6/2014 | |
| JP | 2015-190216 | | 11/2015 | |

OTHER PUBLICATIONS

JPS58103275 (Year: 1987).*

(Continued)

*Primary Examiner* — Lauren A Crane
(74) *Attorney, Agent, or Firm* — Morrison & Foerster LLP

(57) ABSTRACT

A toilet flushing device includes a first rim water pipe within which is formed a first water passage through which water flows to a first rim discharge hole, through which water is discharged to a rim part of a toilet bowl. The first rim water pipe extends from the first rim discharge hole toward a rear part of the toilet bowl, and the rear part side of the first rim water pipe is positioned lower than the first rim discharge hole.

12 Claims, 6 Drawing Sheets

(56) References Cited

OTHER PUBLICATIONS

International Preliminary Report on Patentability dated Oct. 2, 2018, directed to International Application No. PCT/JP2017/002270; 13 pages.
International Search Report dated Mar. 21, 2017, directed to International Application No. PCT/JP2017/002270; 4 pages.

* cited by examiner

TOILET FLUSH DEVICE AND TOILET DEVICE

REFERENCE TO RELATED APPLICATIONS

This application is a national stage application under 35 USC 371 of International Application No. PCT/JP2017/002270, filed Jan. 24, 2017, which claims the priority of Japanese Application No. 2016-070586, filed Mar. 31, 2016, the entire contents of each of which are incorporated herein by reference.

FIELD OF THE INVENTION

The present invention relates to a toilet flushing device and a toilet device.

BACKGROUND OF THE INVENTION

A toilet flushing device discharges water supplied from a water supply source into a toilet bowl of a toilet so as to flush the toilet bowl. The water used to flush the toilet bowl swirls and flows down within the toilet bowl to be discharged together with waste, through a drainage passage part connected to a bottom part of the toilet bowl.

For example, Patent Document 1 discloses a toilet flushing device comprising a rim water passage through which water flows to a rim part formed in an inner peripheral part of an upper opening part of the toilet bowl. The toilet flushing device also comprises a water pipe that is connected to a flush water supply part provided in the rear of the toilet bowl and that extends horizontally from the rear of the toilet bowl to the rim part of the toilet bowl, and the rim water passage is formed within the water pipe.

Patent Document 1 Japanese Unexamined Patent Application Publication No. 2003-213773

Meanwhile, for comfortable use of toilets for users, a toilet in these days is provided with various devices, such as a washing device for washing buttocks, a toilet seat heating device for warming the toilet seat, a blower device for providing warm air into the toilet bowl, and a washing foam supply device. However, with the toilet flushing device described in Patent Document 1, since the water pipe extends horizontally from the rear of the toilet bowl to the rim part on the upper part of the toilet bowl, when such various devices are disposed above the water pipe, the rear part of the toilet device becomes higher than the upper part of the toilet bowl, which has been an interference with downsizing of toilet devices.

The present invention has been made in view of the above-described circumstances, and a purpose thereof is to provide a toilet flushing device and a toilet device that enable downsizing of the toilet device.

SUMMARY OF THE INVENTION

A toilet flushing device according to the present invention comprises a first water passage through which water flows to a first rim discharge hole formed in an upper part of a toilet bowl, wherein the first water passage extends from the first rim discharge hole toward the rear side of the toilet bowl, and the rear part side of the first water passage is positioned lower than the first rim discharge hole.

In the present invention, the toilet flushing device comprises a first water passage through which water flows to a first rim discharge hole formed in an upper part of a toilet bowl. The first water passage extends from the first rim discharge hole toward the rear side of the toilet bowl, and the rear part side of the first water passage is positioned lower than the first rim discharge hole. Accordingly, since a water supply passage leading to the first water passage can be provided at a low position, a space for accommodating various devices can be ensured above the water supply passage, so that the toilet device can be downsized.

According to the present invention, the first water passage extends from the first rim discharge hole toward the rear side of the toilet bowl, and the rear part side of the first water passage is positioned lower than the first rim discharge hole. Accordingly, since a water supply passage leading to the first rim water passage can be provided at a low position, a space for accommodating various devices can be ensured above the water supply passage, so that the toilet device can be downsized.

BRIEF DESCRIPTION OF THE DRAWINGS

An embodiment will now be described, by way of example only, with reference to the accompanying drawings which are meant to be exemplary, not limiting, in which.

DETAILED DESCRIPTION OF THE INVENTION

Figure 1:
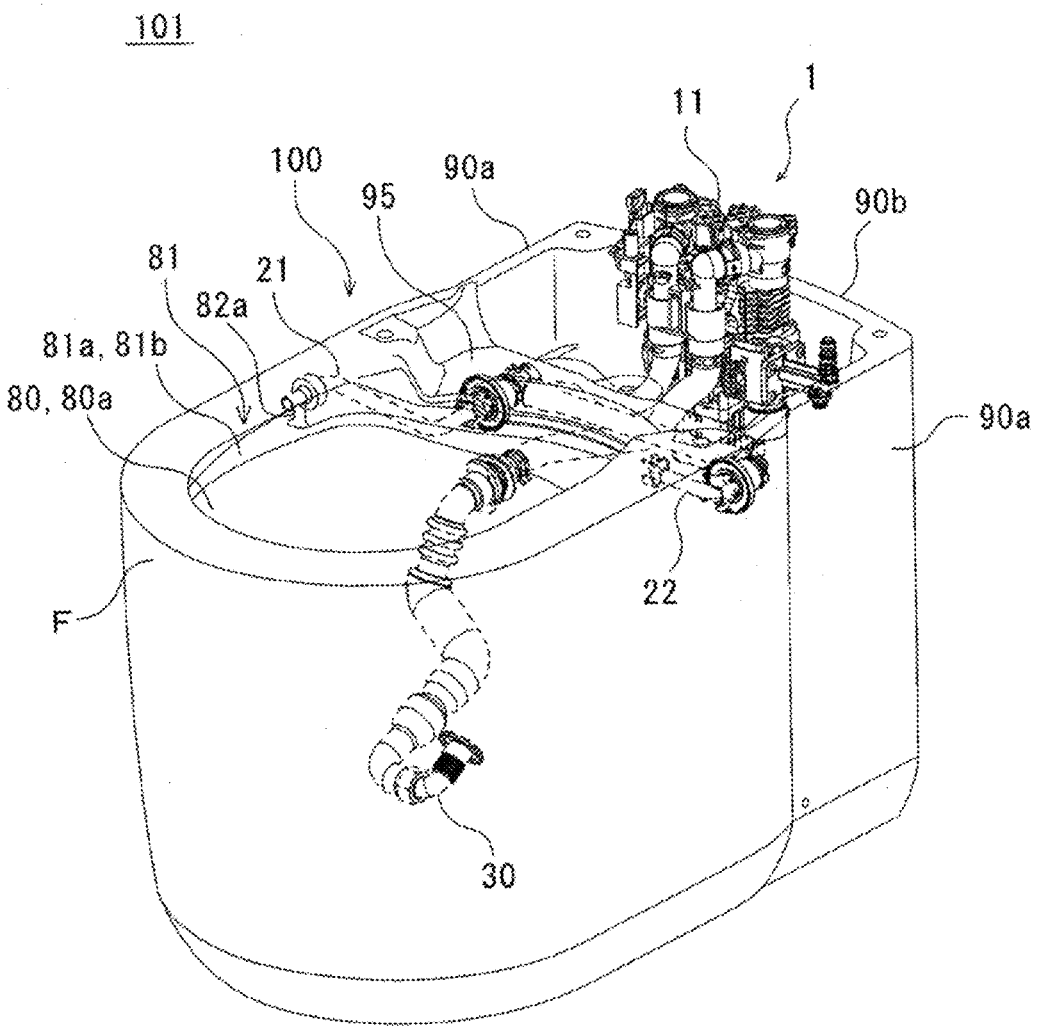
FIG. 1 is a perspective view that shows an external view of a toilet device provided with a toilet flushing device according to an embodiment.

In the following, the present invention will be described based on a preferred embodiment with reference to FIGS. 1 through 6. Same reference characters denote same or corresponding constituting elements and members in each drawing, and the repetitive description will be omitted as appropriate. Also, the dimensions of a member may be appropriately enlarged or reduced in each drawing in order to facilitate understanding. Further, in each drawing, part of a member less important in describing the embodiment may be omitted.

Figure 2:
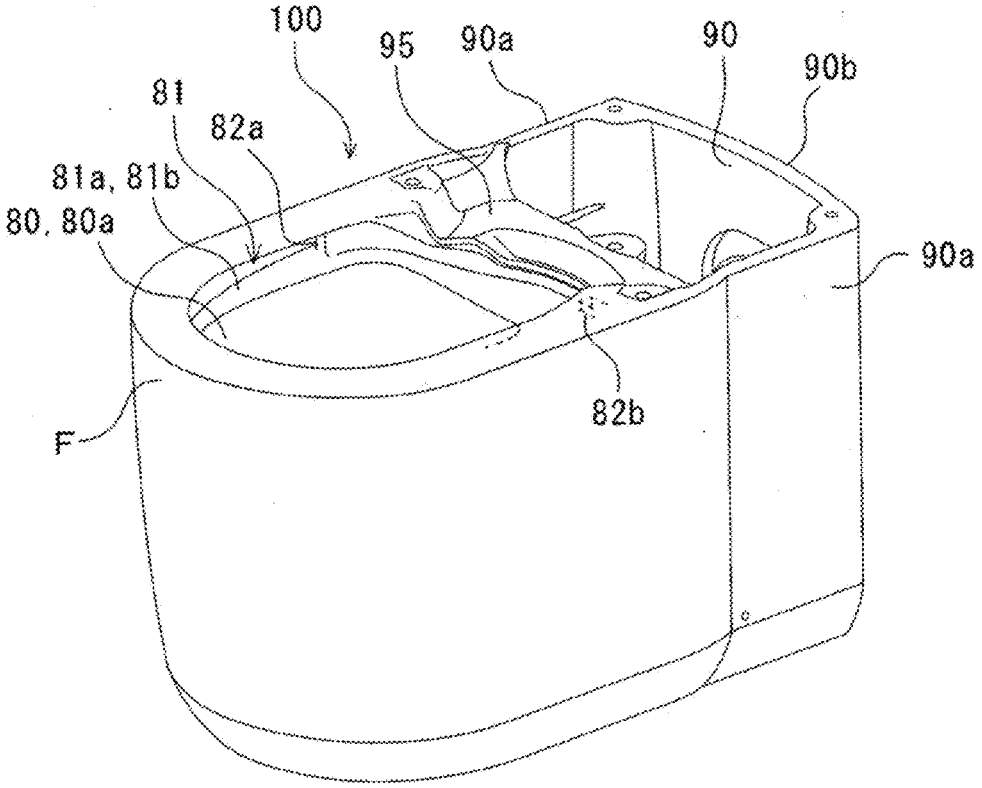
FIG. 2 is a perspective view that shows an external view of a toilet.

FIG. 1 is a perspective view that shows an external view of a toilet device 101 provided with a toilet flushing device 1 according to an embodiment, and FIG. 2 is a perspective view that shows an external view of a toilet 100. The toilet 100 comprises a toilet bowl 80 on the front end F side, and a device housing part 90 in the rear of the toilet bowl 80. The device housing part 90 houses, besides a flush water supply part 11 of the toilet flushing device 1, devices (hereinafter, referred to as "various devices") such as a washing device for washing buttocks, a toilet seat heating device for warming the toilet seat, a blower device for providing warm air into the toilet bowl 80, and a washing foam supply device. The toilet device 101 is constituted by the toilet 100, toilet flushing device 1, various devices, and the likes. Each part of a peripheral edge portion at the upper end of the toilet 100 is located at nearly the same height position, and a recess 95, which is one step lower than the peripheral edge portion, is formed between the toilet bowl 80 and the device housing part 90.

The toilet bowl 80 comprises a receiving surface part 80*a* of a bowl-like shape that receives waste, and a rim part 81 formed on an inner peripheral part of the upper opening part. In the rim part 81 shown in FIGS. 1 and 2, a rim conduit 81*b* is formed such as to receive, at a shelf part 81*a*, water discharged through a first rim discharge hole 82*a* and a second rim discharge hole 82*b* and to lead the water to swirl in one direction. The shelf part 81*a* is formed to have a gradient that is gentler than the inner peripheral surface portion of the receiving surface part 80*a* provided continuously with the lower side of the shelf part 81*a*. The rim conduit 81*b* is formed along nearly the entire circumference of the inner peripheral part at the upper end of the toilet bowl 80. The rim part 81 is formed such that the front end F side and both the left and right sides are located at nearly the same height position, and the rear part side is located at a position one step lower than the height position. Each of the left and right sides is connected to the rear part side by an inclined surface. Viewed from the front end F side, in the rim part 81 on the left side of the toilet bowl 80, the first rim discharge hole 82*a* facing in the front direction is provided. Also, in the rim part 81 on the right rear side of the toilet bowl 80, the second rim discharge hole 82*b* facing in the left direction is provided. The first rim discharge hole 82*a* and the second rim discharge hole 82*b* communicate with an attachment hole 85 or the like, which will be described later, provided on the device housing part 90 side in the rear of the toilet bowl 80.

At the first rim discharge hole 82*a*, a tip end part of a first rim water pipe 21 of the toilet flushing device 1, which will be described later, is disposed. Through the first rim discharge hole 82*a*, water supplied from the first rim water pipe 21 is discharged. The water discharged through the first rim discharge hole 82*a* flows through the rim conduit 81*b* of the rim part 81, from the left side through the front side to the right side, and then flows down into the toilet bowl 80 along the receiving surface part 80*a* while swirling in one direction. Also, at the second rim discharge hole 82*b*, a tip end part of a second rim water pipe 22 of the toilet flushing device 1, which will also be described later, is disposed. Through the second rim discharge hole 82*b*, water supplied from the second rim water pipe 22 is discharged. The water discharged through the second rim discharge hole 82*b* flows through the rim conduit 81*b* of the rim part 81, from the rear part side to the left side, to merge with the water discharged through the first rim discharge hole 82*a*, and then flows down into the toilet bowl 80 along the receiving surface part 80*a* while swirling in one direction.

The water flowing down along the receiving surface part 80*a* is discharged together with waste, through a drainage passage connected to a bottom part of the toilet bowl 80. To the upstream side of the drainage passage is attached a jet water pipe 30 of the toilet flushing device 1, which will be described later. The water discharged through the jet water pipe 30 merges with the water flowing down along the receiving surface part 80*a*, so that the flow rate of the water is increased. Thereafter, the water is discharged through the drainage passage.

The device housing part 90 includes left and right wall bodies 90*a* and a rear wall body 90*b* provided in a rear part of the toilet 100, and the front side of the device housing part 90 opens on the recess 95. The left and right wall bodies 90*a* and the rear wall body 90*b* are provided along the range from the bottom part to the upper end part of the toilet 100. The device housing part 90 houses the flush water supply part 11 of the toilet flushing device 1 and the aforementioned various devices, in a space surrounded by the left and right wall bodies 90*a* and the rear wall body 90*b* and in a space above the recess 95. The various devices are suitably housed in the upper end part side of the device housing part 90 in consideration of accessibility without mechanical interference with the water pipes of the toilet flushing device 1.

Figure 3:
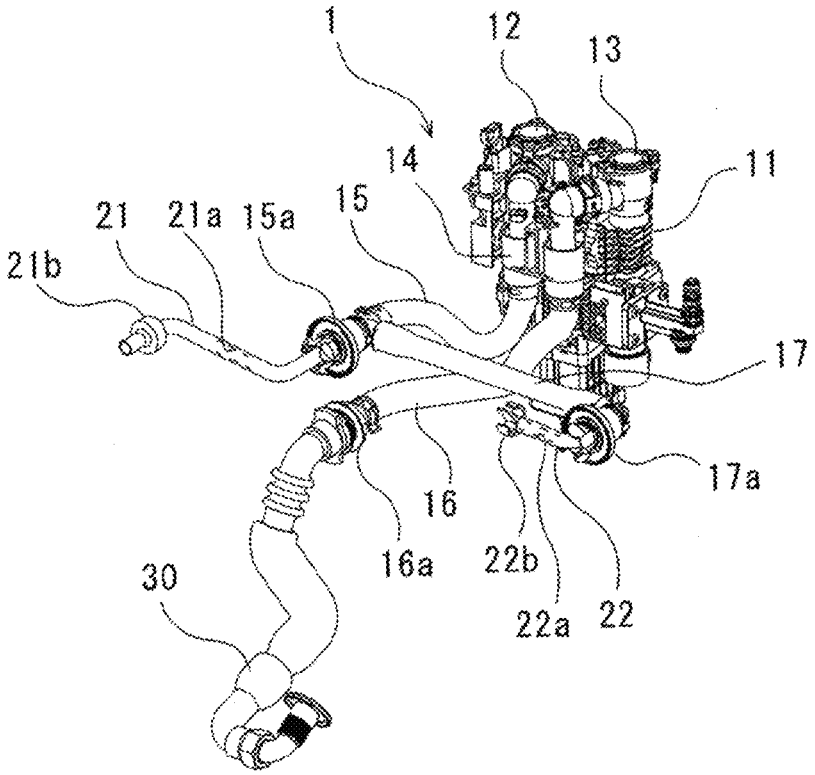
FIG. 3 is a perspective view that shows an external view of a toilet flushing device.
Figure 4:
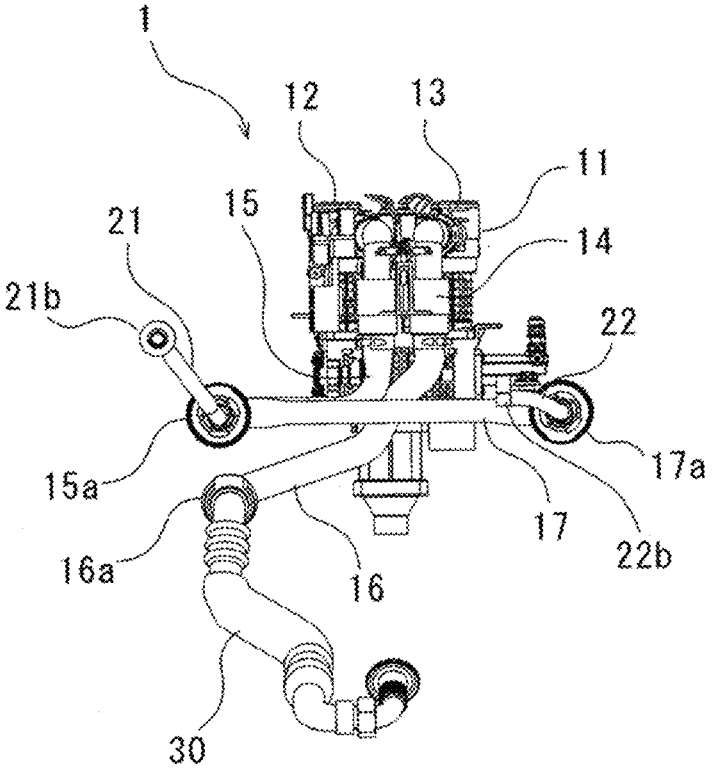
FIG. 4 is a front view of the toilet flushing device.

FIG. 3 is a perspective view that shows an external view of the toilet flushing device 1, and FIG. 4 is a front view of the toilet flushing device 1. The toilet flushing device 1 comprises the flush water supply part 11, a socket part 14, the first rim water pipe 21, the second rim water pipe 22, and the jet water pipe 30. The flush water supply part 11 is provided with multiple valves that adjust the flow rate and the pressure of water supplied from a water supply source and that control supplying and stopping of the water, and the flush water supply part 11 discharges water through a rim-side discharge port 12 and a jet-side discharge port 13 to supply the water to the downstream side. The flush water supply part 11 is housed inside the device housing part 90 such that pipes connected to the rim-side discharge port 12 and the jet-side discharge port 13 are inserted into the socket part 14 from the above.

The socket part 14 includes two cylindrical sockets into which the pipes connected to the rim-side discharge port 12 and the jet-side discharge port 13 are respectively inserted. To each socket of the socket part 14, a corresponding one of an end part of a rim-side pipe 15 and an end part of a jet-side pipe 16, which are made of a soft material, is attached. The rim-side pipe 15 extends downward from the socket part 14 and is bent in the left direction and further bent frontward to reach a pipe fixing part 15*a*. The jet-side pipe 16 extends in the lower left direction from the socket part 14 and is bent frontward to reach a pipe fixing part 16*a*.

The rim-side pipe 15 includes a rim-side branched pipe 17 that branches off, in the right direction, before the pipe fixing part 15*a*. The rim-side branched pipe 17 extends horizontally in the left direction and is bent frontward to reach a pipe fixing part 17*a*. The pipe fixing part 15*a* is attached to the attachment hole 85, which will be described later, provided in the rear of the toilet bowl 80. Similarly, the pipe fixing parts 16*a* and 17*a* are also attached respectively to attachment holes provided in the rear of the toilet bowl 80.

The first rim water pipe 21 is made of a soft or hard material, and a first water passage 21*a* is formed within the first rim water pipe 21. The tip end part, which is the downstream end part, of the first rim water pipe 21 is horizontally linear and is fitted to the first rim discharge hole 82*a* via a control member 21*b* of a ring shape and disposed almost in parallel with the rim part 81. The "horizontal" in the present specification includes, besides the case of being completely horizontal with respect to a horizontal plane, the case of being almost horizontal with respect to a horizontal plane. The first rim water pipe 21 is bent rearward in an obliquely lower right direction from the tip end part and further bent horizontally rearward to reach the rear end part. The rear end part of the first rim water pipe 21 is attached to the pipe fixing part 15*a* and fixed to the attachment hole 85 provided on the toilet 100.

The second rim water pipe 22 is made of a soft or hard material, and a second water passage 22*a* is formed within the second rim water pipe 22. The tip end part, which is the downstream end part, of the second rim water pipe 22 has a linear shape, and is fitted to the second rim discharge hole 82*b* by means of a control part 22*b*, which is provided with three tongue-shaped pieces formed in a radial direction, and disposed almost in parallel with the rim part 81. The second rim water pipe 22 is bent rearward from the tip end part to reach the rear end part. The rear end part of the second rim water pipe 22 is attached to the pipe fixing part 17*a* and fixed to the attachment hole provided on the toilet 100.

The jet water pipe 30 is configured by partially combining hard pipes and soft pipes and by appropriately providing a bellows part at a midway thereof so as to provide stretching properties. The tip end part of the jet water pipe 30 is attached to the upstream side of the drainage passage connected to the bottom part of the toilet bowl 80. The jet water pipe 30 once extends frontward from the tip end part and is bent rearward in an obliquely upper left direction and further bent rearward to reach the rear end part. The rear end part of the jet water pipe 30 is attached to the pipe fixing part 16*a* and fixed to the attachment hole provided on the toilet 100.

Figure 5:
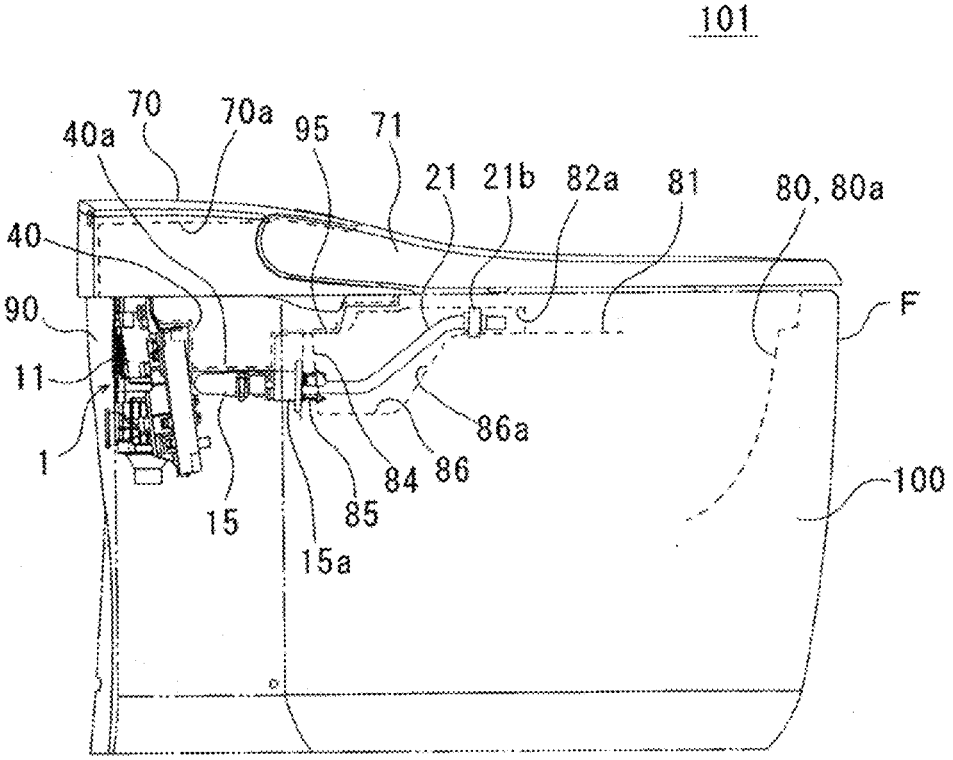
FIG. 5 is a side view of the toilet flushing device and a lid part.

There will now be described functions based on the arrangement of the toilet flushing device 1 of the embodiment. FIG. 5 is a side view of the toilet flushing device 1 and a lid part 70. The lid part 70 is attached to an upper end part of a rear part of the toilet 100 such as to cover the device housing part 90. A toilet lid 71 for covering the toilet bowl 80 from above is axially supported and attached to the front side of the lid part 70 such as to be openable and closable.

In the first rim water pipe 21, the tip end part is located at the same height position as the left side of the rim part 81, and the rear end part is positioned lower than the tip end part. Accordingly, the rim-side pipe 15 connected to the rear end part of the first rim water pipe 21 can be provided at a position lower than the rim part 81. Also, since the rim-side branched pipe 17 is provided such as to branch off from the rim-side pipe 15, the rim-side branched pipe 17 can also be provided at a position lower than the rim part 81.

FIG. 5 shows an example of a base plate 40 on which the various devices are mounted. The base plate 40 is provided such as not to mechanically interfere with the rim-side pipe 15 and the rim-side branched pipe 17. Since each of the rim-side pipe 15 and the rim-side branched pipe 17 is provided at a position lower than the rim part 81, a bottom part 40*a* of the base plate 40 can be provided at a lower position, so that a space for accommodating the various devices can be ensured above the bottom part 40*a*. Therefore, the height of the rear part of the toilet device 101 can be reduced, so that the toilet device 101 can be downsized.

Figure 6:
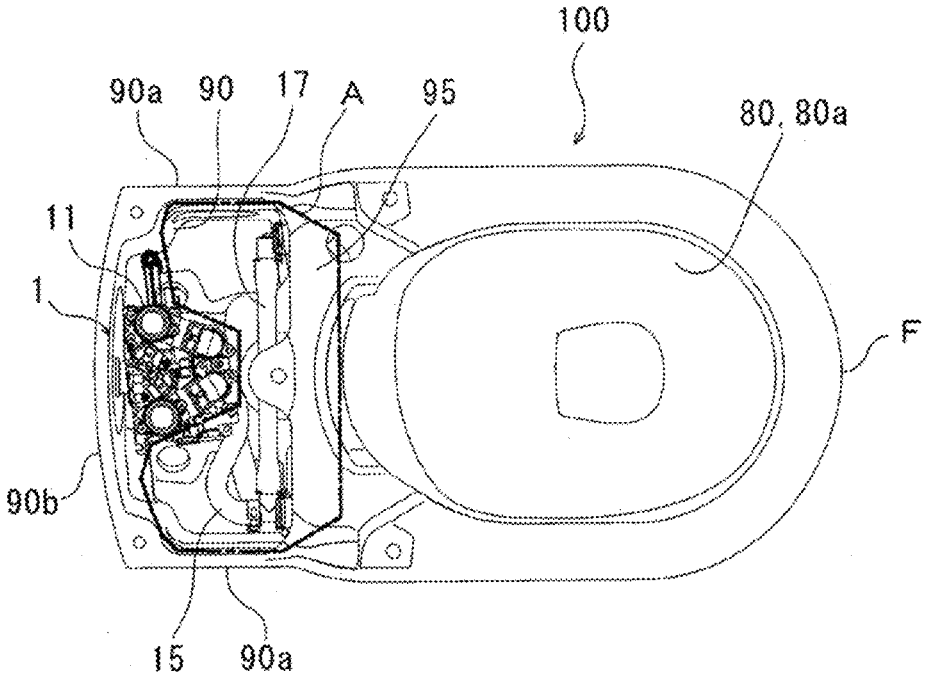
FIG. 6 is a plan view of the toilet flushing device and the toilet.

FIG. 6 is a plan view of the toilet flushing device 1 and the toilet 100. A region A indicated by a dashed dotted line in FIG. 6 includes regions on both the left and right sides of the flush water supply part 11 and a region including the recess 95 in front of the flush water supply part 11, and, in the region A, the various devices can be disposed without mechanically interfering with the flush water supply part 11. Since the bottom part 40*a* of the base plate 40 can be provided at a lower position, a space from the bottom part 40*a* to a top surface 70*a* can be ensured, so that the various devices can be disposed therein, also using a space above the recess 95.

Since the bottom part 40*a* of the base plate 40 is located at a low position, the position at which the various devices are installed can be lowered, so that the height position of the lid part 70 can also be lowered. By smoothly connecting the upper surfaces of the lid part 70 and the toilet lid 71, the entirety of the toilet device 101 can be unitedly downsized. Also, by disposing part of the various devices in the space above the recess 95, the height position of the lid part 70 can be further lowered.

As described previously, in the first rim water pipe 21 of the toilet flushing device 1, the tip end part is fitted to the first rim discharge hole 82*a* via the control member 21*b*, and the rear end part is fixed to the pipe fixing part 15*a* attached to the attachment hole 85 provided on the toilet 100. As shown in FIG. 5, the attachment hole 85 is formed to be pierced through the front side and the back side of a separating wall 84 provided below the recess 95. Between the first rim discharge hole 82*a* and the attachment hole 85 is provided a cavity part 86, in which an inclined surface 86*a* is formed such that the frond side thereof, which reaches the first rim discharge hole 82*a*, is higher, and the rear side thereof is lower.

The first rim water pipe 21 is inserted into the cavity part 86 from the rear side via the attachment hole 85 and is further pushed into the cavity part 86 while the tip end part of the first rim water pipe 21 is in contact with the inclined surface 86*a*, so that the tip end part is led frontward and upward along the inclined surface 86*a* to reach the first rim discharge hole 82*a*. When the first rim water pipe 21 is made of a hard material, the first rim water pipe 21 is less likely to be deformed, so that the workability is favorable when the first rim water pipe 21 is pushed while being in contact with the inclined surface 86*a* to be installed.

Also, in the first rim water pipe 21, since the tip end part is fitted to the first rim discharge hole 82*a* via the control member 21*b*, and the rear end part is fixed to the pipe fixing part 15*a* attached to the attachment hole 85, looseness caused while water flows can be restrained. Accordingly, a stable flow of water can be formed along the receiving surface part 80*a* by the water discharged through the first rim discharge hole 82*a*.

Although the first rim water pipe 21 has a bent shape from the tip end part to the rear end part, the tip end part is formed into a linear shape, so that water flowing through the pipe can be straightened in the tip end part of the linear shape to be discharged through the first rim discharge hole 82*a*. Similarly, although the second rim water pipe 22 has a bent shape from the tip end part to the rear end part, the tip end part is formed into a linear shape, so that water flowing through the pipe can be straightened in the tip end part of the linear shape to be discharged through the second rim discharge hole 82*b*.

In the following, the features of the toilet flushing device 1 according to the embodiment will be described.

The toilet flushing device 1 according to the embodiment of the present invention comprises the first rim water pipe 21 within which is formed the first water passage 21*a* through which water flows to the first rim discharge hole 82*a* formed in an upper part of the toilet bowl 80. The first rim water pipe 21 extends from the first rim discharge hole 82*a* toward the rear side of the toilet bowl 80, and the rear part side of the first rim water pipe 21 is positioned lower than the first rim discharge hole 82*a*. Accordingly, since the rim-side pipe 15, within which a water supply passage leading to the first water passage 21*a* is formed, can be provided at a low position, a space for accommodating the various devices can be ensured above the rim-side pipe 15, so that the toilet device 101 can be downsized.

The toilet flushing device 1 also comprises the second rim water pipe 22 within which is formed the second water passage 22*a* through which water flows to the second rim discharge hole 82*b* formed in an upper part of the toilet bowl 80. The second rim water pipe 22 communicates with the rear part side of the first rim water pipe 21 within which the first water passage 21*a* is formed. The second rim water pipe 22 communicates with the rear part side of the first rim water pipe 21 positioned lower than the first rim discharge hole 82*a*. Accordingly, since the rim-side branched pipe 17, within which a water supply passage leading to the second water passage 22*a* is formed, can be provided at a low position, a space for accommodating the various devices can be ensured above the rim-side branched pipe 17, so that the toilet device 101 can be downsized.

In the first rim water pipe 21 of the toilet flushing device 1, the tip end part, which is the downstream end part on the first rim discharge hole 82*a* side, is formed to be horizontally linear. Accordingly, water flowing through the first rim water pipe 21 can be straightened in the tip end part of the linear shape and discharged through the first rim discharge hole 82*a*.

The first water passage 21*a* of the toilet flushing device 1 is formed inside the first rim water pipe 21 as a water pipe. In the first rim water pipe 21, the tip end part is attached to the first rim discharge hole 82*a*, and the rear end part is attached to the attachment hole 85 provided in the rear of the toilet bowl 80. Accordingly, looseness in the first rim water pipe 21 caused while water flows can be restrained, and a stable flow of water can be formed along the receiving surface part 80*a* by the water discharged through the first rim discharge hole 82*a*.

The toilet 100 includes the inclined surface 86*a*, in which the first rim discharge hole 82*a* side is higher, provided in the cavity part 86 between the first rim discharge hole 82*a* and the attachment hole 85. Accordingly, since the first rim water pipe 21 can be installed such that the tip end part thereof is inserted into the attachment hole 85 to be led along the inclined surface 86*a* to reach the first rim discharge hole 82*a*, the workability is favorable.

Although the first water passage 21*a* is formed inside the first rim water pipe 21 in the aforementioned embodiment, the first water passage 21*a* may be formed as a first passage leading to the first rim discharge hole 82*a*, in an upper peripheral edge part of the toilet 100. The first passage is formed, when the toilet 100 is formed of ceramic or resin, as a passage made of ceramic or resin inside the toilet 100. By inclining the first passage such that the rear end part thereof is positioned lower than the first rim discharge hole 82*a*, a water supply passage connected to the rear end part can be provided at a low position, so that a space for accommodating the various devices can be ensured above the water supply passage.

Similarly, the second water passage 22*a* may be formed as a second passage leading to the second rim discharge hole 82*b*, in an upper peripheral edge part of the toilet 100. As with the first passage described above, the second passage is formed, when the toilet 100 is formed of ceramic or resin, as a passage made of ceramic or resin inside the toilet 100. The second passage communicates with the rear end part of the first passage and allows the water supplied from the water supply passage to flow through to the second rim discharge hole 82*b*.

Also, although the second water passage 22*a*, the second passage, and the second rim discharge hole 82*b* are positioned lower than the first rim discharge hole 82*a* in the aforementioned embodiment, the second rim discharge hole 82*b* may be provided at a height position similar to that of the first rim discharge hole 82*a*. In this case, each of the second water passage 22*a* and the second passage, of which the tip end part as the downstream end part is disposed at the second rim discharge hole 82*b*, has only to be provided such that the tip end part is higher, and the rear end part is lower.

Also, although the toilet flushing device 1 is configured to include the flush water supply part 11 provided with multiple valves in the aforementioned embodiment, the toilet flushing device 1 may be configured to include, instead of the flush water supply part 11, a water supply pipe in which supplying and stopping of water is controlled using an on-off valve, so as to supply water to the first water passage 21*a* and the second water passage 22*a*.

The present invention has been described with reference to an embodiment. The embodiment is intended to be illustrative only, and it will be obvious to those skilled in the art that various modifications and changes could be developed within the scope of claims of the present invention and that such modifications and changes also fall within the scope of claims of the present invention. Therefore, the description in the present specification and the drawings should be regarded as exemplary rather than limitative.

EXPLANATION OF REFERENCE NUMERALS

1 toilet flushing device
21 first rim water pipe (water pipe)
21*a* first water passage
22*a* second water passage
80 toilet bowl
81 rim part
82*a* first rim discharge hole
82*b* second rim discharge hole
85 attachment hole
86*a* inclined surface
101 toilet device The present invention relates to a toilet flushing device and a toilet device.

The invention claimed is:

1. A toilet device comprising:
a toilet comprising a toilet bowl; and
a toilet flushing device, wherein
the toilet comprises a device housing part in the rear of the toilet bowl;
the toilet flushing device comprises a first water passage through which water flows to a first rim discharge hole formed in an upper part of the toilet bowl, and comprises a water supply passage from which water is supplied to the first water passage;
the device housing part configured to house one of a washing device for washing buttocks, a toilet seat heating device for warming the toilet seat, a blower device for providing warm air, or a washing foam supply device;
the toilet device further comprises a base plate on which the device housed in the device housing part is mounted;
a part of an internal space, in which a device is housed, of the device housing part is provided at a higher position than the water supply passage and the base plate, and is provided at a lower position than a peripheral edge portion at an upper end of the toilet; and
the internal space of the device housing part is provided in front of a back end of the toilet,
the first water passage extends from the first rim discharge hole toward a rear side of the toilet bowl, and a rear part side of the first water passage is positioned lower than the first rim discharge hole.

2. The toilet device of claim 1, further comprising a second water passage through which water flows to a second rim discharge hole formed in an upper part of the toilet bowl, wherein
the second water passage communicates with the rear part side of the first water passage positioned lower than the first rim discharge hole.

3. The toilet device of claim 1, wherein the first water passage is formed such that a downstream end part thereof on the first rim discharge hole side is formed to be horizontally linear.

4. The toilet device of claim 1, wherein:

the first water passage is formed inside a water pipe; and, one end part of the water pipe is attached to the first rim discharge hole, and the other end part of the water pipe is attached to an attachment hole provided in the rear of the toilet bowl.

5. The toilet device of claim 2, wherein:

the first water passage is formed inside a water pipe; and, one end part of the water pipe is attached to the first rim discharge hole, and the other end part of the water pipe is attached to an attachment hole provided in the rear of the toilet bowl.

6. The toilet device of claim 5, wherein:

the toilet comprises an inclined surface provided between the first rim discharge hole and the attachment hole; and the first rim discharge hole side is higher in the inclined surface.

7. The toilet device of claim 2, wherein the first water passage is formed such that a downstream end part thereof on the first rim discharge hole side is formed to be horizontally linear.

8. The toilet device of claim 3, wherein:

the first water passage is formed inside a water pipe; and, one end part of the water pipe is attached to the first rim discharge hole, and the other end part of the water pipe is attached to an attachment hole provided in the rear of the toilet bowl.

9. The toilet device comprising of claim 7, wherein:

the toilet comprises an inclined surface provided between the first rim discharge hole and the attachment hole; and the first rim discharge hole side is higher in the inclined surface.

10. The toilet device of claim 5, wherein:

the toilet comprises an inclined surface provided between the first rim discharge hole and the attachment hole; and the first rim discharge hole side is higher in the inclined surface.

11. The toilet device of claim 1, wherein the first water passage comprises an inclined part inclining in such a way as to extend in an obliquely upper direction as it goes forward.

12. The toilet device of claim 1, further comprising a recess formed on an upper surface of the toilet in the rear of the toilet bowl, wherein the rear part of the first water passage is provided at a lower position than the recess.

* * * * *